US006703917B2

(12) United States Patent
Belenger et al.

(10) Patent No.: US 6,703,917 B2
(45) Date of Patent: Mar. 9, 2004

(54) RESETTABLE FUSE/CIRCUIT INTERRUPTER WITH VISUAL FAULT INDICATION

(75) Inventors: Robert V. Belenger, Raynham, MA (US); Gennaro R. Lopriore, Somerset, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 22 days.

(21) Appl. No.: 09/977,901

(22) Filed: Oct. 10, 2001

(65) Prior Publication Data

US 2003/0128095 A1 Jul. 10, 2003

(51) Int. Cl.[7] ..... H01H 37/08; H01H 37/02; H01H 37/04

(52) U.S. Cl. ..... 337/376; 337/56; 337/66; 337/91; 337/343; 337/348; 337/365; 337/367; 337/89; 200/308; 200/310; 200/314

(58) Field of Search ..... 337/89, 36, 37, 337/53, 56, 66, 85, 91, 206, 265, 266, 333, 343, 348, 365, 332, 367, 376, 380, 381; 200/308, 310, 313, 314

(56) References Cited

U.S. PATENT DOCUMENTS 3,913,049 A * 10/1975 Burch ..... 337/75
4,281,322 A * 7/1981 Nasu et al. ..... 340/638
4,325,046 A * 4/1982 Burch ..... 337/56
4,635,021 A * 1/1987 Hsieh ..... 337/76
4,672,351 A * 6/1987 Cheng ..... 337/123
5,012,495 A * 4/1991 Munroe et al. ..... 337/3
5,491,460 A * 2/1996 Krasser et al. ..... 337/70
5,844,465 A * 12/1998 Armenio et al. ..... 337/377
5,995,380 A * 11/1999 Maue et al. ..... 361/826
6,072,381 A * 6/2000 Yu ..... 337/37
6,275,134 B1 * 8/2001 Chen ..... 337/37
2001/0006365 A1 * 7/2001 Yu ..... 337/68
2002/0149464 A1 * 10/2002 Santa Cruz et al. ..... 337/376

* cited by examiner

*Primary Examiner*—Anatoly Vortman
(74) *Attorney, Agent, or Firm*—James M. Kasischke; Jean-Paul A. Nasser; Michael F. Oglo

(57) ABSTRACT

A circuit interrupter device protects a load circuit from excessive, or overloading levels of current, provides a visual indication of circuit overload and open circuit, and can be reset. A multi-metallic heat reactive strip is snapped by an overload current to open the load circuit and close a light emitter circuit having a current limiting resistor connected to an indicator lamp that provides a visual indication of the open circuit. The multi-metallic strip is manually reset via a push button to open the light emitter circuit and extinguish the indicator lamp and close the load circuit to reestablish operation therein. The circuit interruption device can be made utilizing currently available technology for miniature fusing in tight, confining spaces and/or assemblies that have unusual shapes that restrict access in automobile electrical systems, test instruments, domestic appliances or many other electronic/electrical circuits.

11 Claims, 2 Drawing Sheets

RESETTABLE FUSE/CIRCUIT INTERRUPTER WITH VISUAL FAULT INDICATION

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

Not applicable.

BACKGROUND OF THE INVENTION (1) Field of the Invention

The present invention relates generally to fuses for circuits. More particularly, this invention relates to a multi-metallic heat reactive strip that snaps when conducting an overloaded current to interrupt a load circuit and turn on an indicator light.

(2) Description of the Prior Art

Most fuse systems in automotive electrical systems, test instruments, and domestic appliances use miniature fuses that fit into tight spaces. These fuses are partially made of materials that melt and part when they are subjected to overloads of current, and the fuses do not clearly indicate that a circuit has been overloaded and broken at the fuse. Consequently, operators may not be aware of the overloaded and open-circuit condition until sometime much later when some other event develops that will more surely attract their attention. After being overloaded, the fuses with the melted materials cannot be reset and must be replaced with intact units to resume whatever it was that the associated circuits were doing. Sometimes the replacements are not immediately at hand, and the associated circuits might have to be shutdown for a considerable period until replacements are located and installed.

Thus, in accordance with this inventive concept, a need has been recognized in the state of the art for a device to interrupt a circuit when subjected to overload current, to provide a clearly visual indication of such overload and interruption, and to have the capability to be reset to reestablish a closed circuit.

SUMMARY OF THE INVENTION

The first object of the invention is to provide a circuit having a multi-metallic heat reactive strip to interrupt and indicate an overload current.

Another object is to provide a circuit having a multi-metallic heat reactive strip to interrupt and indicate an overload current that can be reset after being tripped by the overload current.

Another object is to provide a circuit having a multi-metallic heat reactive strip snapped to a lamp to indicate a fault condition.

Another object is to provide a circuit having a multi-metallic heat reactive strip responding to overload current with snap action to activate a lamp.

Another object is to provide a circuit interrupter device having a multi-metallic heat reactive strip being snapped, or tripped to open a load circuit and close a light emitter circuit that visually indicates current overload and being reset to reestablish a closed circuit.

Another object of the invention provides a circuit interrupter including a snap-action multi-metallic heat reactive strip being reset and used in miniature circuitry in confining spaces.

Another object of the invention is to provide a circuit interrupter including a temperature-sensitive snap-action multi-metal strip to produce a visual indication of a fault condition by a lamp and being capable of being reset.

Another object is to provide a compact circuit interrupter device adaptable to miniaturization and having a multi-metallic heat reactive strip being snapped to open a load circuit and close a light emitter circuit to visually indicate current overload and capable of being reset to reestablish a closed circuit without spring loading structure of present circuit breaker designs.

These and other objects of the invention will become more readily apparent from the ensuing specification when taken in conjunction with the appended claims.

Accordingly, the present invention is a circuit interrupter for indicating and removing overload current from a load. A snap action multi-metallic heat reactive strip snaps from coupling current to a load circuit to a light emitter circuit when a predetermined magnitude of excessive, or overload current heats the multi-metal heat reactive strip. An indicator lamp in the light emitting circuit provides a visual indication of the overload condition. A manual push button engages the multi-metal heat reactive strip to reset and snap the strip back to coupling power to the load.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals refer to like parts and wherein.

DESCRIPTION OF THE PREFERRED EMBODIMENTS

Figure 1:
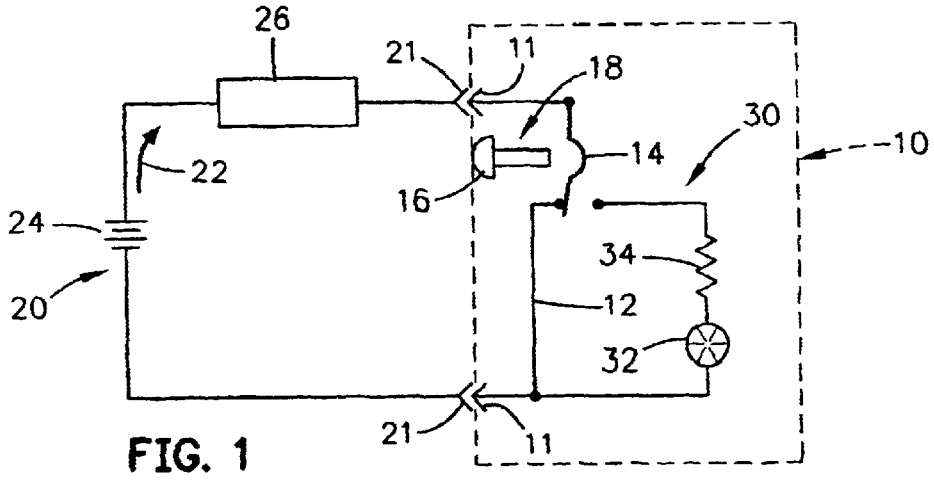
FIG. 1 is a schematic circuit diagram showing the multi-metallic heat reactive strip of the circuit interrupter device of the invention connecting current to a load during a normal operating condition.
Figure 2:
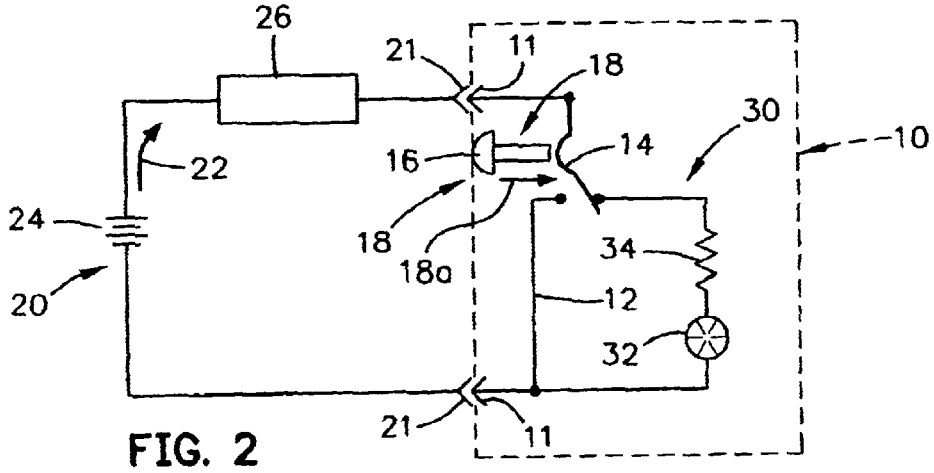
FIG. 2 is a schematic circuit diagram showing the multi-metallic heat reactive strip of the circuit interrupter device of the invention connected to an indicator light in a light emitting circuit during a snapped, or tripped condition.

Referring to FIGS. 1 and 2 of the drawings, circuit interrupter device 10 of this invention is coupled to a load circuit 20 to conduct current 22 from a source of electrical power 24 through electronic/electrical components and assemblies of a load 26. Circuit interrupter device 10 prevents excessive, or overload currents in load circuit 20 from damaging the constituents of load 26 and, snaps to a light emitter circuit 30 of circuit interrupter device 10 that gives a visual indication that an overload current condition exists in load circuit 20.

Circuit interrupter device 10 can be made in rectangularly-shaped modularized packages from off-theshelf components and has elongate electrodes 11 that fit into mating sockets 21 of load circuit 20. When electrodes 11 are plugged into sockets 21, a conductor section 12 and a multi-metallic heat reactive strip 14 of circuit interrupter device 10 complete, or close load circuit 20.

Figure 4:
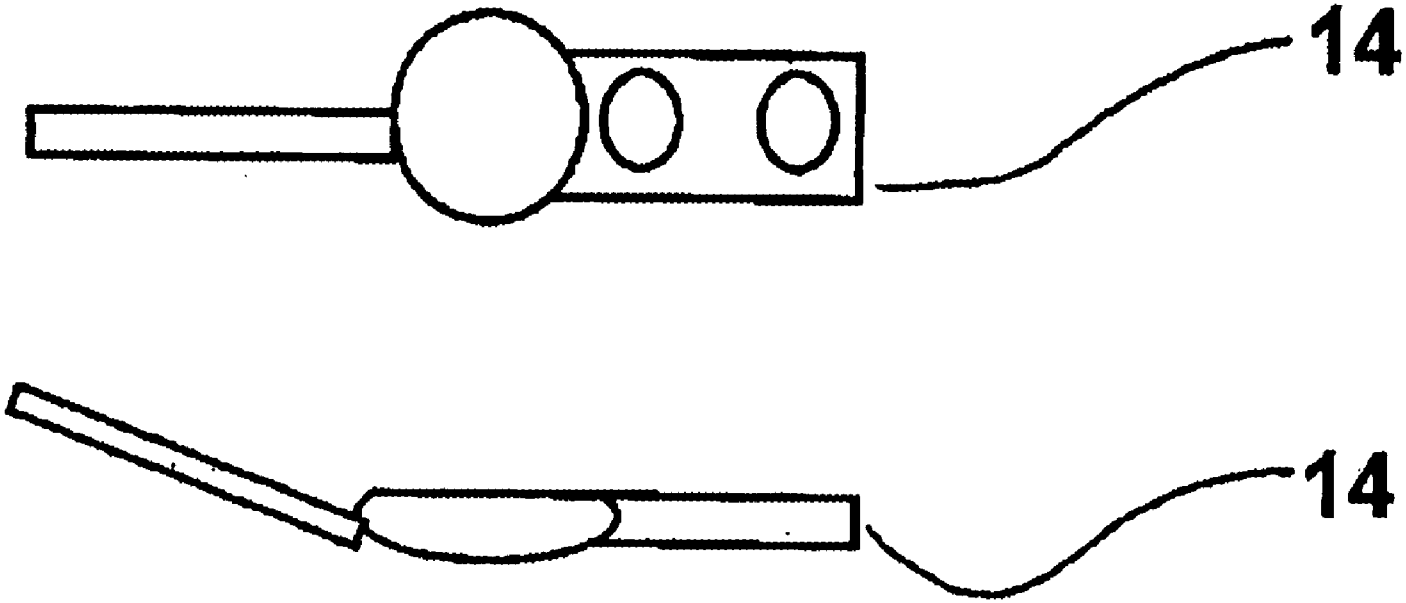
FIG. 4 shows side and top views of the multi-metallic heat reactive strip (14) in a disc shape.

Multi-metallic heat reactive strip 14 snaps from one shape to another shape when a current that exceeds a predetermined magnitude is coupled to it and heats it sufficiently to cause its heat stressed condition to snap, or trip it to another shape. Heat reactive strips are well known and some widely used disc shaped strips have been formed into domed-shapes that snap to inverted domed-shaped configurations in response to changes in temperature. The simplicity of discs and their ease of manufacture are contributing factors for their widespread use. Accordingly, a disc-shaped multi-metallic heat reactive strip 14 can be made by pressing a flat disc of multi-metallic heat reactive material between steel dies until it assumes a desired domed configuration as shown in FIGS. 1 and 2. Other shapes for multi-metallic heat reactive strip 14 can be made, such as rectangular or tongue-shaped, for examples, as different applications may require. FIG. 4 shows strip 14 in a disc shape from a top and side view.

The dome-shaped multi-metallic heat reactive strip 14 of circuit interrupter device 10 along with conductor section 12 normally completes a closed circuit for current 22 from electrical power source 24 through electronic/electrical components and assemblies that make up load 26. This is the normal operating condition shown in FIG. 1.

When, however, dome-shaped multi-metallic heat reactive strip 14 becomes heated by current 22 that increases to excessive, or overload levels for one reason or another, multi-metallic heat reactive strip 14 is quickly stressed by the heat generated. The stresses generated by heating multi-metallic heat reactive strip 14 to the heated condition by currents that exceed a predetermined overload magnitude create the only forces used to snap multi-metallic heat reactive strip 14 into an inverted dome shape. The stressed multi-metallic heat reactive strip 14 that has snapped to the inverted dome shape opens load circuit 20 and virtually simultaneously closes light emitter circuit 30, see FIG. 2. Since the now-closed light emitter circuit 30 has an indicator lamp 32 serially connected to a current limiting resistor 34, indicator lamp 32 provides an immediate visual indication that an overload condition has been created in load circuit 20 and that load circuit 20 is open.

Circuit interrupter device 10 provides a fusing function as described above that is clearly, visually indicated for appropriate action. However, circuit interrupter device 10 of this invention has a reset capability after cooling from its heated condition for reactivation of load circuit 20 with acceptable levels of current 22. In other words, the light radiating from indicator lamp 32 will draw an operator's attention to load circuit 20 and appropriate action will be taken in regard to correcting or ignoring the excessive levels of current. Ignoring and resetting may be the right procedure, when, for example, a non-damaging, isolated stray transient current may have been created by a single isolated, non-repeatable incident.

After circuit interrupter 10 has cooled below the snap-action temperature of its heated condition, an operator pushes-in a push-button 16 of a reset push button mechanism 18 of circuit interrupter device 10 in the indicated arrow direction 18*a* to reset it. This reset is accomplished by displacing the inverted dome shape of multi-metallic heat reactive strip 14 via push button 16 until multi-metallic heat reactive strip 14 snaps to its previous dome shape as shown in FIG. 1. The snapped multi-metallic heat reactive strip 14 opens light emitter circuit 30 to extinguish indicator lamp 32 by isolating it from power source 24 and virtually simultaneously closes load circuit 20 to permit its reactivation.

Under normal conditions, current 22 is within acceptable limits and circuit interrupter device 10 allows current 22 to flow through load 26, and light emitter circuit 30 is isolated from power source 24. When multi-metallic heat reactive strip 14 is tripped by increased overload levels of current 22, it snaps quickly to open load circuit 20, close light emitter circuit 30 through current limiting resistor 34 and light indicator lamp 32. Once tripped, multi-metallic heat reactive strip 14 remains in the tripped condition due to its physical properties. Manually depressing push button 16 of push button mechanism 18 is required to return multi-metallic heat reactive strip 14 to its normal operating condition.

Circuit interrupter device 10 usually is reset by pressing and releasing reset push button 16 once multi-metallic heat reactive strip 14 has cooled below its snap action temperature. Optionally, multi-metallic heat reactive strip 14 can be reset in place as circuit interrupter device 10 is connected to load circuit 20, or circuit interrupter device 10 can be removed from load circuit 20 by pulling electrodes 11 from sockets 21, and strip 14 is reset. Then, circuit interrupter device 10 is returned and plugged into sockets 21 when the overload condition that caused the trip has been fixed.

Figure 3A:
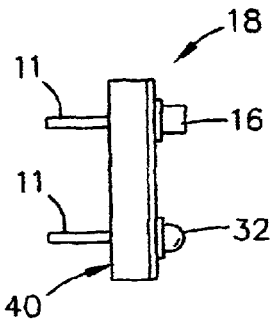
FIGS. 3A, 3B, and 3C schematically show side, top, and bottom views of the package of the interrupter circuit device of the invention.
Figure 3B:
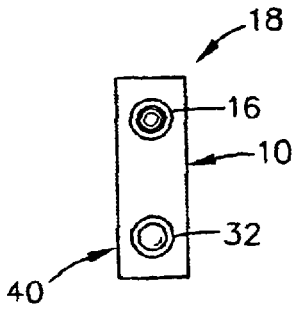
Figure 3C:
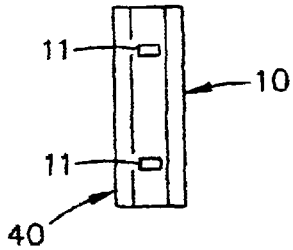

Circuit interrupter device 10 can be modularized and miniaturized by current technologies in a compact environmentally resistant housing 40 as depicted in the side, top, and bottom views depicted in FIGS. 3A, 3B, and 3C, respectively. First and second electrodes 11 extend from the bottom of housing 40 and manual push button 16 of reset push button mechanism 18 and indicator lamp 32 of light emitter circuit 30 are prominently located to extend outwardly from the top surface. Selection of components from among contemporary fast acting miniature multi-metallic strips, miniature light emitting devices, and other constituents and interfacing them in compact rugged modular housing 40 for a job at hand can be readily done without requiring anything beyond ordinary skill.

Circuit interrupter device 10 of this invention can be fabricated compact enough to be used in many miniature circuit applications such as those found in automobile electrical systems, test instruments, domestic appliances and many other electronic/electrical circuits. Circuit interrupter device 10 answers the need for miniature fusing in tight, confining spaces and/or assemblies that have unusual shapes that restrict access. It also greatly reduces the problems inherent in the circuit breakers and fuse arrangements of the prior art that are associated with identifying overloaded circuits and tripped fusing devices in crowded, tight, or hard-to-get-at fuse panels, particularly under low light conditions. Additional benefits from using multi-metallic heat reactive strips 14 of the invention of circuit interrupter device 10 are that the fusing, status indicating, and resetting functions are performed without reliance on complicated and bulky spring loading structures like those used in many contemporary circuit breaker designs. Thus, circuit interrupter device 10 can be made more compactly and is further capable of miniaturization to help assure higher reliability for more of the tighter arrangements of electronic/electrical components and assemblies.

The disclosed components and their arrangements as disclosed herein all contribute to the novel features of this invention. Circuit interrupter device 10 of this invention provides a reliable and cost-effective means to improve the reliability and responsive operation of many electronic and electrical assemblies. Therefore, circuit interrupter device 10 as disclosed herein is not to be construed as limiting, but rather, is intended to be demonstrative of this inventive concept.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A device for interrupting a load circuit and indicating a current overload condition comprising:

first and second electrodes being coupled to a load circuit, said load circuit having a source of electrical power to connect current to a load;

a light emitter circuit having an indicator lamp serially connected to a current limiting resistor, said light emitter circuit being connected to said first electrode; and a multi-metallic heat reactive strip connected to said first and second electrodes having a first shape to close said load circuit and conduct said current in said load circuit, said multi-metallic beat reactive strip being heated to a heated condition by said current exceeding a predetermined overload magnitude to snap said multi-metallic heat reactive strip into a second shape to open said load circuit and close said light emitter circuit, said indicator lamp of said light emitter circuit radiating light to visually indicate said current exceeding said predetermined overload magnitude and said open load circuit, wherein said first shape is dome shaped and said second shape is inverted dome shaped.

2. The device of claim 1 wherein stresses generated by heating said multi-metallic heat reactive strip to said heated condition by said current exceeding a predetermined overload magnitude create the only forces used to snap said multi-metallic heat reactive strip into said second shape.

3. The device of claim 2 further comprising:

means adjacent to said multi-metallic heat reactive strip for manually resetting said multi-metallic heat reactive strip from said second shape to said first shape.

4. The device of claim 3 wherein said manually resetting means snaps said multi-metallic heat reactive strip back to said first shape.

5. The device of claim 4 further comprising:

a housing having said first and second electrodes extending from its bottom and said manually resetting means and said indicator lamp extending from its top surface.

6. The device of claim 5 wherein said first and second electrodes are inserted into sockets connected to said load circuit and said manually resetting means is a push button of a reset push button mechanism extending through said housing.

7. The device of claim 1 further comprising:

a push button adjacent to said multi-metallic heat reactive strip for manually resetting said multi-metallic heat reactive strip front said second inverted dome shape to said first dome shape, wherein resetting said multi-metallic heat reactive strip is accomplished by displacing said inverted dome shaped multi-metallic heat reactive strip by said push button until said multi-metallic heat reactive strip snaps to its previous dome shape after it has cooled from said heated condition.

8. The device of claim 7 wherein said multi-metallic heat reactive strip opens the light emitter circuit and virtually simultaneously closes said load circuit during resetting of said multi-metallic heat reactive strip.

9. A device for interrupting a load circuit and indicating a current overload condition comprising:

first and second electrodes being coupled to a load circuit, said load circuit having a source of electrical power to connect current to a load;

a light emitter circuit having an indicator lamp serially connected to a current limiting resistor, said light emitter circuit being connected to said first electrode;

a multi-metallic heat reactive strip connected to said first and second electrodes having a first dome shape to close said load circuit and conduct said current in said load circuit, said multi-metallic heat reactive strip being heated to a heated condition by said current exceeding a predetermined overload magnitude to snap said multi-metallic heat reactive strip into a second inverted dome shape said heated condition by said current exceeding a predetermined overload magnitude create the only forces to snap said multi-metallic heat reactive strip into said second inverted dome shape to open said load circuit and close said light emitter circuit, said indicator lamp of said light emitter circuit radiating light to visually indicate said current exceeding said predetermined overload magnitude and said open load circuit;

a push button adjacent to said multi-metallic heat reactive strip for manually resetting said multi-metallic heat reactive strip from said second inverted dome shape to said first dome shape, where resetting involves snapping the multi-metallic heat reactive strip back to the first shape after it has cooled from said heated condition; and a housing having said first and second electrodes extending from its bottom and said push button mechanism and said indicator lamp, extending from its top surface wherein said first and second electrodes are inserted into sockets connected to said load circuit and said push button mechanism extends through said housing.

10. The device of claim 9 wherein resetting said multi-metallic heat reactive strip is accomplished by displacing said inverted dome shaped multi-metallic heat reactive strip by said push button until said multi-metallic heat reactive strip snaps to its previous dome shape after it has cooled from said heated condition.

11. The device of claim 10 wherein said multi-metallic heat reactive strip opens said light emitter circuit and virtually simultaneously closes the load circuit during resetting of said multi-metallic heat reactive strip.

* * * * *